US005098558A

United States Patent [19]

Knoll et al.

[11] Patent Number: 5,098,558

[45] Date of Patent: Mar. 24, 1992

[54] ADJUSTABLE FEED ACCELERATOR FOR PARTICLE SEPARATOR

[75] Inventors: Frank S. Knoll; Arnold H. Jackson, both of Jacksonville, Fla.

[73] Assignee: Carpco, Inc., Jacksonville, Fla.

[21] Appl. No.: 456,857

[22] Filed: Dec. 27, 1989

[51] Int. Cl.[5] ..... B03C 7/04; B03C 7/06

[52] U.S. Cl. ..... 209/127.3; 209/920

[58] Field of Search ..... 209/127.1, 127.3, 127.4, 209/920

[56] References Cited

U.S. PATENT DOCUMENTS

| | | | |
|---|---|---|---|
| 2,848,108 | 8/1958 | Brastad et al. | 209/127.3 |
| 3,322,275 | 5/1967 | Breakiron et al. | 209/127.1 |
| 3,720,312 | 3/1973 | Shook et al. | 209/127.3 X |
| 4,116,822 | 9/1978 | Webb | 209/127.1 X |
| 4,226,703 | 10/1980 | Stout | 209/127.3 |
| 4,325,820 | 4/1982 | Whitlock | 209/127.1 |
| 4,849,099 | 7/1989 | Knoll et al. | 209/127.1 |

OTHER PUBLICATIONS

FMC Corporation Catalog, 1983 (pp. E-9 and E-12).

*Primary Examiner*—Margaret A. Focarino
*Assistant Examiner*—Dean J. Kramer
*Attorney, Agent, or Firm*—Arthur G. Yeager

[57] ABSTRACT

In an inclined pan feeding apparatus for presenting or discharging particulate material onto a conveyor including a feed hopper, a generally horizontal pan to receive particles from the hopper and deliver the particles in a thin layer to a conveyor belt or roll; the improvement wherein the pan is adjustably inclined downwardly from the hopper to a spillway edge above the belt or roll, the pan being attached to the stationary frame through a front pair of vibration absorbers and a rear pair of vibration absorbers, a rotating motor with eccentric weights is attached to the pan to cause the pan to vibrate generally horizontally, the motor being selectively positioned vertically on the back of the pan, and the front pair of vibration absorbers being selectively positioned at spaced locations along the sides of the pan; and a skirt of flexible plastic fringe hanging closely above and parallel to the spillway edge of the pan.

23 Claims, 3 Drawing Sheets

ADJUSTABLE FEED ACCELERATOR FOR PARTICLE SEPARATOR

BACKGROUND OF THE INVENTION

Electrostatic particle separators are used to separate different types of small particles by using their electrostatic attraction and repulsion properties. Generally the mixture of particles to be separated is conveyed along a flat surface from a feed hopper to a rotating separation roll. The final treatment of the particles is to feed them as a thin layer onto the rotating roll, which then rotates the particles through an electrostatic field to charge some of the particles so as to enhance the separation process. In machines which accomplish these treatments it is necessary to bring the velocity of the particle movement up to approach as closely as possible the surface velocity of the roll, so that the layer of particles is easily transferred to the roll with a minimum of agitation. Such machines are shown in our patents U.S. Pat. Nos. 4,421,148 and 4,849,099 for use in separating fine particles, where the final particle velocity is reached by dropping the particles down a vertical chute to be accelerated by gravity to the appropriate velocity for discharge onto the drum. It is the purpose of the present invention to accomplish a separation of coarse particles wherein the final particle acceleration does not include vertical falling, since that tends to incorporate a certain amount of unwanted bounce or agitation of the particles.

Prior art wide tray feeders usually have included a plurality of electromagnetic vibratory drive units spaced along its width, as illustrated for example by the FMC wide spreader feeder at page. E-12, of Catalog 100, 1983, "FMC Corporation Syntron and Link Belt Material Handling Equipment". Rather than the multiple electromagnetic vibratory drive units used in the FMC wide spreader feeder, the invention herein employs a single rotating motor with eccentric weights to achieve the requisite vibratory feeder to accelerate the particles. Thus, uneven feeding along the width of the tray due to a number of factors, including the multiple drive units becoming out of synchronization, causing eddy currents in the feed bed. In accord with this invention, the tray's vibration throughout the width experiences one amplitude of vibration and moves the feed bed uniformly of the width of the tray. Attendant advantages include a much more compact design occupying less volume within an electrostatic particle separator, for example.

It is an object of this invention to provide a novel apparatus for presenting or delivering coarse particles onto a conveyor. It is another object of this invention to provide a novel apparatus for electrostatic separation of particles in which the particles being fed to a separation roll are accelerated to the proper speed by moving down a vibrated inclined plane. A further object is to provide an accelerating means which breaks up agglomerates of the particles and feeds a single thickness of particles onto an electrostatic separating means. Still other objects will become apparent from the more detailed description which follows.

BRIEF SUMMARY OF THE INVENTION

This invention relates to a particle accelerator particularly for use with an electrostatic particle separating apparatus which has a supply hopper for holding the particles, a generally horizontal pan for receiving particles from the hopper, and an electrostatically charged conveyor onto which particles are fed from the pan. The receiving pan includes a generally inclined receiving surface with a back, a front edge and two sides, such surface being inclined downwardly from the back to the front edge with the front edge spaced vertically above a rotating roll. A rotating motor having eccentric weights is attached to the pan adjacent the back at selected vertically spaced locations and adapted to cause the pan to vibrate in a generally horizontal movement perpendicular to the front edge. A flexible fringe is suspended above the surface closely adjacent to the front edge. The pan is supported by and attached to the apparatus through a pair of spaced front vibration absorbers and a pair of spaced back vibration absorbers with the vibration absorbers being capable of absorbing substantially all vibrations of the pan and transmitting substantially none of the vibrations to the remainder of the apparatus. The front vibration absorbers are selectively positionable along the sides adjacent the front edge at any of a plurality of spaced attachment locations.

In specific and preferred embodiments of this invention the receiving pan is mounted on two front vibration absorbers remote from each other adjacent the lateral ends of the front edge, and two rear vibration absorbers are closely spaced apart from each other on the back of the pan and generally medially of the sides of the pan. In another preferred embodiment the vibrations of the pan are made by an eccentric motor attachable to the back of the pan in selective locations spaced vertically apart from each other.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The important features of this invention are best understood by reference to the attached drawings which illustrate the receiving pan and the particle accelerating device for use with an electrostatic particle separating machine. This type of machine is employed to separate mixtures of different kinds of particles, e.g., plastic, paper, metal, etc., by using the differences in the electrostatic properties of the particles causing some of the particles to cling to an electrically charged rotating roll while other particles are repelled by the roll.

Figure 1:
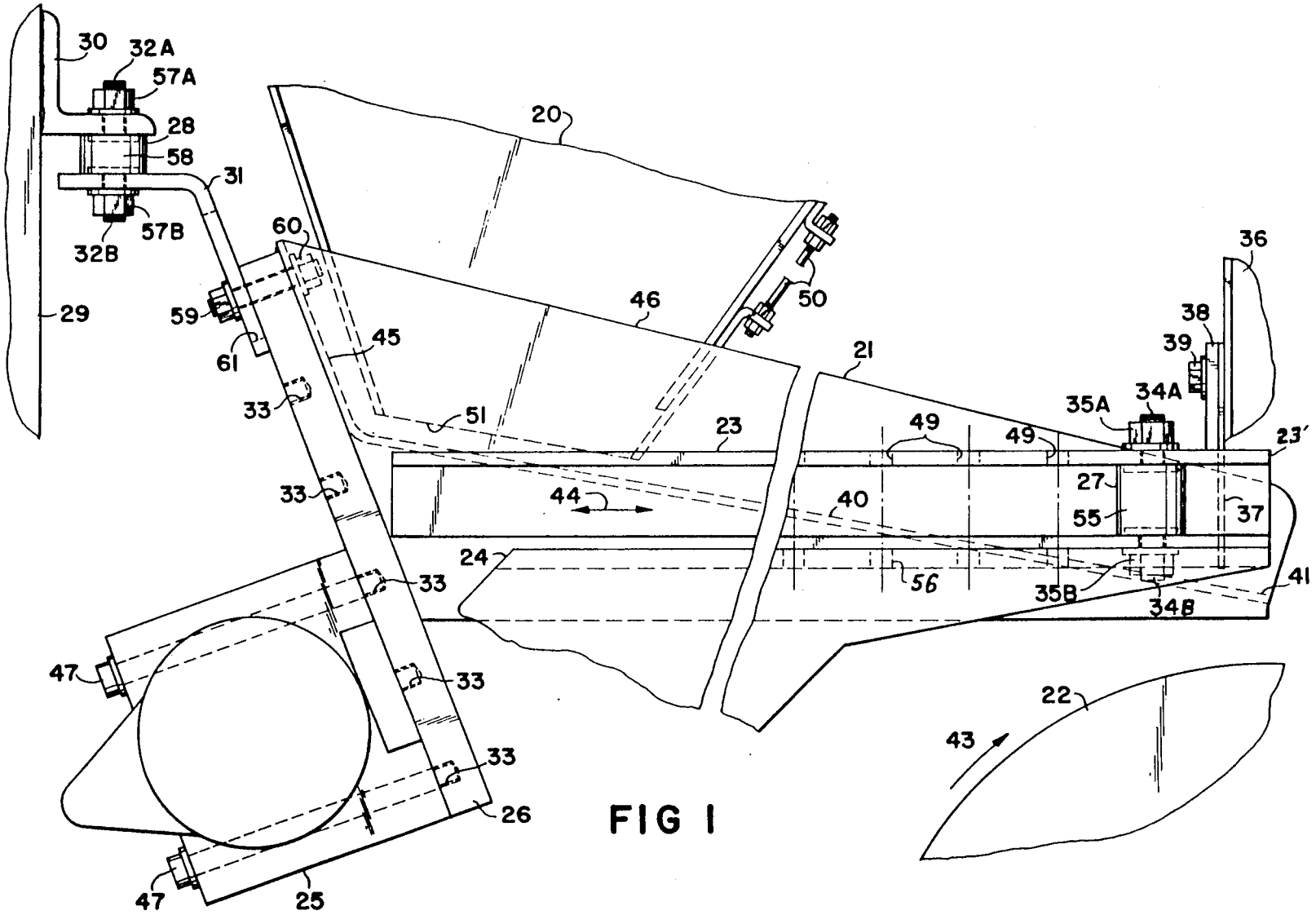
FIG. 1 is a side elevational view of the receiving pan and its associated components in the apparatus of this invention.

In accord with the present invention the receiving pan is vibrated by a single rotating motor with eccentric weights cooperating with other components to accelerate the particles before they are conducted through a separation zone. In FIG. 1 the receiving pan 21 is positioned below hopper 20, which contains a supply of mixed coarse particles, e.g., chopped plastic and pieces of copper wire, that are to be separated by the apparatus, and above a moving surface like a conveyor or a rotating roll 22, which conducts the mixed particles through an electrostatic field causing a separation of one type of particle from another type. Particles from hopper 20 empty through a bottom opening having an adjustment means 50 for varying the amount of opening and thus the feed bed of particles, and then onto pan 21 by gravity with the rate of particle flow being controlled by the selected size of the bottom opening. Pan 21 is positioned such that the bottom of pan 21 (which supports the particles received from hopper 20) is inclined downwardly from a high elevation at the back 45 of pan 21 under hopper 20 to a lower elevation at the forward or front discharge edge 41 where the particles fall a short distance onto the surface of roll 22 passing underneath edge 41. In place of a roll 22 there may be a moving belt or any other type of conveyor able to carry the particles through an electrostatic field.

Receiving pan 21 is vibrated to cause the particles to move toward discharge edge 41. The vibration is caused by a reciprocatory motion in the generally horizontal direction of arrow 44, preferably perpendicular to discharge edge 41. Preferably, arrow 44 will be parallel to bottom 40 of pan 41, although the exact direction of vibrational movement may be at a small angle away from parallel to bottom 40. The vibrational movement preferably is caused by a variable speed, rotating motor 25, with included eccentric weights, which is attached to support plate 26, which, in turn, is rigidly affixed, as by welding to the back 45 of pan 21. Plate 26 is fashioned with a plurality of vertically spaced means for attachment of motor 25. Shown in FIG. 1 are holes 33 capable of receiving bolts or nuts 47 for attaching motor 25 to plate 26. It has been found that by providing a plurality of attachment locations for motor 25, there can be achieved a plurality of adjustments to the direction, and force of the vibrations imparted by motor 25 to pan bottom 40.

Pan 21 is attached to the remainder of the separation apparatus by means of a plurality of vibration absorbers, such as a mass of rubber or elastomer, or a spring device. The purpose of the vibration absorbers is to permit pan 21 to be vibrated and to confine the vibration to pan 21 and not allow the vibrations to pass through the attaching absorbers into the surrounding machinery and framework. Preferably there are two pairs of vibration absorbers placed symmetrically around a central plane 48 of pan 21 perpendicular to discharge edge 41 and bisecting pan 21. Forward vibration absorbers 27 are spacedly located along respective side walls 46 adjacent the two ends of discharge edge 41 across the front of pan 21. Rear vibration absorbers 28 are located on the back 45 of pan 21 spaced closely to each other but on opposite sides of the central vertical plane 48 of pan 21 which is substantially perpendicular to the front edge 41 and back 45 of pan 21. A particularly desirable location for attachment of rear vibration absorbers 28 is on motor support plate 26 near its upper edge. A preferred vibration absorber used herein is a mass of rubber with two embedded studs emerging from opposite ends of the rubber mass.

Figure 2:
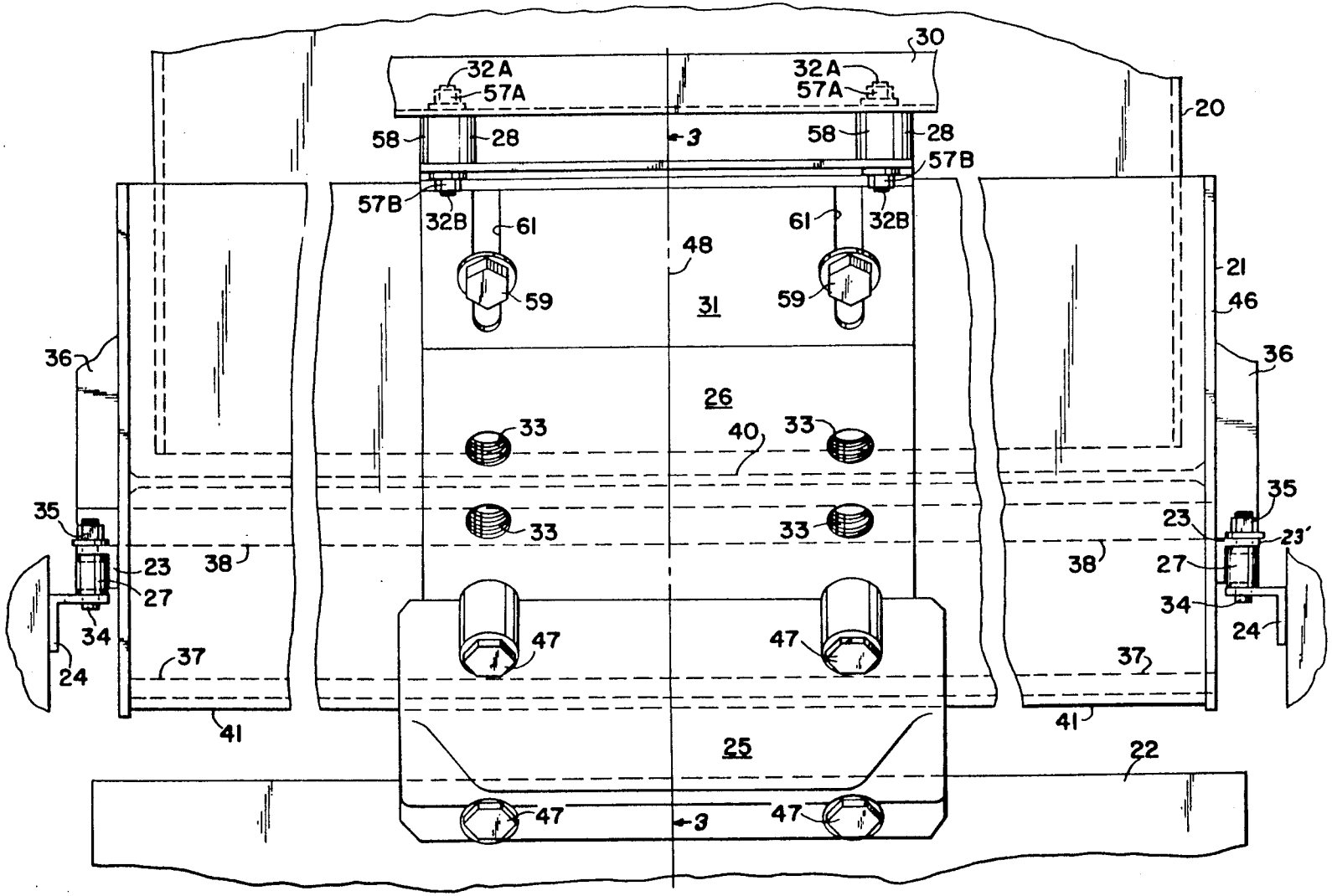
FIG. 2 is a rear elevational view of the receiving pan of FIG. 1.
Figure 3:
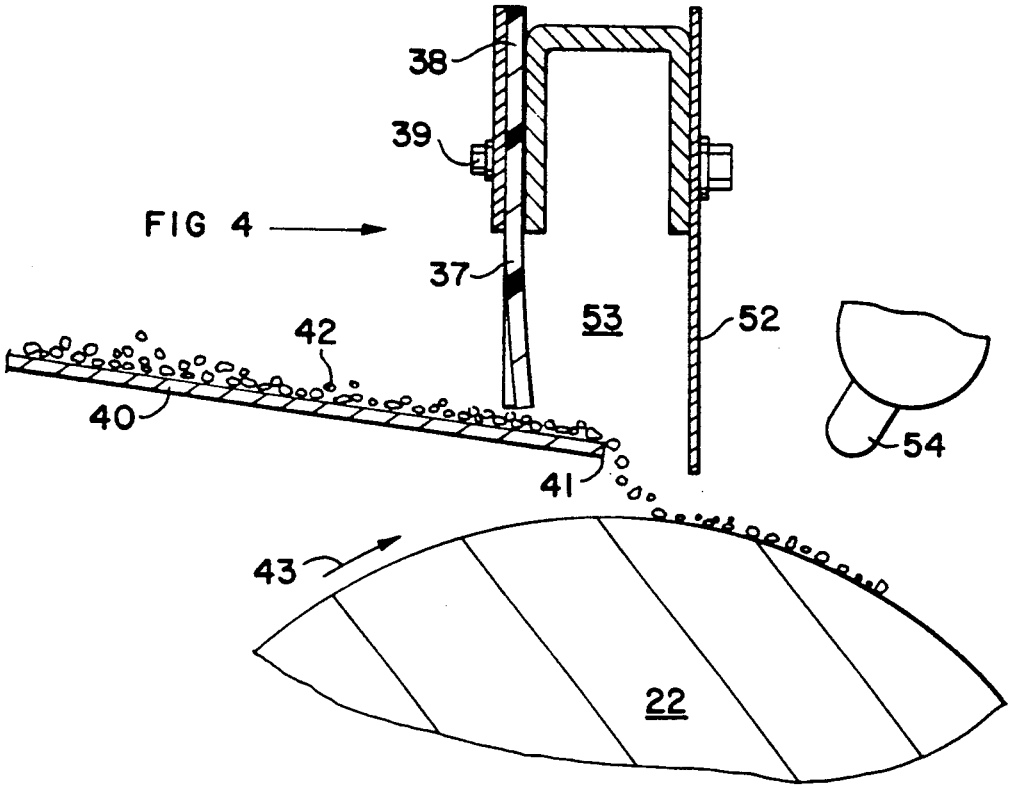
FIG. 3 is a cross sectional view of a portion of the apparatus taken at 3—3 of FIG. 2.

The attachment of forward vibration absorbers 27 to pan 21 is preferably made by way of a plurality of spaced selective positions. This is accomplished by providing an angle beam 23 rigidly affixed to the sides 46 of pan 21 as by welding. This leaves an outwardly projecting horizontal flange 23' through which are spaced holes 49 for attachment of forward vibration absorbers 27. A similar angle beam 24 parallel to beam 23 is positioned and attached in the surrounding frame, as clearly shown in FIG. 2, to provide the corresponding second attachment holes 56 in vertical alignment with respective holes 49 in beam 23. The vibration absorber 27 is shown as including two separate studs 34A and 34B embedded in a rubber body with the studs passing through respective openings in beams 23 and 24 and nuts 35A and 35B tightened upon the respective flanges of beams 23 and 24 with the mass of rubbery material located between studs 34A and 34B to function as the vibration absorber. The several holes 49 in beam 23 and the corresponding holes 56 in beam 24 provide selective locations for forward vibration absorbers 27, which, in turn, provide means to adjust the vibrational movement to that desired for each task. Accordingly, the selective location of the forward vibration absorbers 27 permits small changes or "tunning" of the feed system for a particular material mixture to enhance the particle separation and/or acceleration for the type, size and density of the particle, as desired. The angle of inclination of bottom surface 40 of pan 21 may vary generally from about 5° to about 30° from the horizontal, preferably 10°-20°. By increasing or decreasing the angle, by varying the position of motor 25 to vary its vibrational forces, and by varying the rotational speed of motor 25 the speed of movement of particles down bottom 40 to discharge edge 41 can be controlled. The goal is to approach a speed at discharge edge 41 such that when the particles fall onto a moving surface like a conveyor or roll 22 they will be moving at substantially the same speed as the surface of roll 22. With a distance of travel of about 8-16 inches the first half of the travel distributes the particles evenly over surface 40, and the last half of the travel causes the particles to separate and accelerate to reach the desired speed after leaving front edge 41 to fall onto roll 22.

Rear vibration absorbers 28 are constructed similarly to front vibration absorbers 27 in that two separate studs 32A and 32B are embedded in a rubber mass 58. The lower stud 32B is fastened by nut 57B to hanger 31 which in turn is fastened to plate 26 by bolts 59 and nuts 60. Slots 61 in hanger 31 provide a means for adjusting plate 26 with respect to hanger 31 so as to raise or lower the back 45 of pan 21 and to adjust the pan 21 with respect to the bottom 51 of hopper 20.

Figure 4:
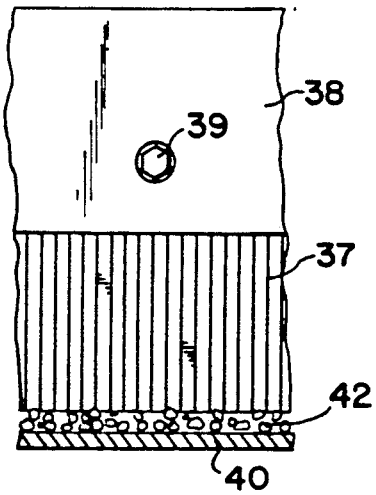
FIG. 4 is a partial rear elevational view taken in the direction of the arrow labeled "FIG. 4" in FIG. 3.

Another purpose of the vibration is to spread out the particles to a layer one particle thick evenly distributed over bottom 40 as they approach discharge edge 41. As shown in FIG. 4, rubber skirt 37 hangs suspended closely above, but does not touch, the particles 42 on bottom 40 as they are moved toward edge 41. Rubber skirt 37 forms an upstream lower extension of the chamber 53 and serves as an air barrier to separate the environment upstream of skirt 37 from that of interior chamber 53. Normally a weak vacuum is maintained within chamber 53 located over edge 41 to prevent dust from passing out onto roll 22. Also, an ion shield 52 of a metallic or conductive strip is suspended above roll 22 with sufficient clearance for the particles to pass thereunder to inhibit premature charging of such particles by electrode 54. Shield 52 forms the downstream lower extension of chamber 53 and acts as an air barrier from the environment downstream of shield 50. The adjustment capabilities of the system of this invention provide all that is necessary to accomplish these purposes. Even though the particles exiting from the hopper 20 onto the pan 21 may be clumped together, the vibration of the pan 21 in the direction of arrow 44 causes the clumps to break up and the particles to become separated as they are accelerated toward edge 21 so that the particles are essentially a single layer thick when they are fed onto roll 22.

The subassembly in accord with this invention is the accelerator unit which comprises pan 21, motor support plate 26, motor 25, and at least four vibration absorbing attachments 27 and 28. Such subassembly may be incorporated into any device wherein coarse particles are fed into pan 21, are vibrated to distribute and separate them across the bottom surface 40 and accelerate them to front edge 41 for separated discharge onto another device for further processing, as a conveying belt or roll as hereinabove specifically shown.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In an electrostatic particle separating apparatus comprising a supply hopper for holding the particles, a generally horizontal pan for receiving particles from said hopper, and a moving surface for receiving said particles from said pan and conducting said particles through an electrostatically charged zone to enhance the separation of a portion of said particles from the remainder thereof; said pan having a generally inclined receiving upper surface with a pair of spaced side walls, a back wall, a front edge, and said upper surface being inclined downwardly from said back wall to said front edge with said front edge spaced vertically above said moving surface; an eccentric motor attached to said pan adjacent said back wall at selected vertically spaced locations and adapted to cause said pan to vibrate in a generally horizontal direction perpendicular to said front edge; a flexible fringe suspended above said upper surface closely adjacent to said front edge; said pan being supported by and attached to said apparatus through a pair of spaced front vibration absorbers and a pair of spaced back vibration absorbers, said vibration absorbers being capable of absorbing substantially all vibrations of said pan and transmitting substantially none of said vibrations to the remainder of said apparatus; means for selectively attaching said front vibration absorbers adjacent said front edge at any of a plurality of spaced attachment locations spacedly away from said front edge toward said back wall.

2. The apparatus of claim 1 wherein said moving surface is a rotating roll.

3. The apparatus of claim 1 wherein said rear vibration absorbers are located generally medially of said side walls and attached to said back wall spaced above said receiving upper surface.

4. The apparatus of claim 1 which additionally comprises two parallel horizontal beams rigidly attached respectively to said two side walls, each said beam extending from adjacent said back wall to adjacent said front edge and having a flange extending outwardly from said respective side wall, said flange having a plurality of spaced holes therethrough to accommodate attachment of said respective front vibration absorber thereto.

5. The apparatus of claim 1 wherein said pan includes a motor support plate rigidly attached to said back wall of said pan medially of said two side walls, and said plate includes a plurality of spaced attachment holes to accommodate attachment of said motor at a plurality of different locations.

6. The apparatus of claim 5 wherein said attachment holes are spaced apart vertically to accommodate different vertical locations of said motor.

7. The apparatus of claim 1 wherein said upper surface is positioned at such an angle that particles traveling down said upper surface are vibrated by said motor and are accelerated in linear speed along said upper surface as said particles approach said front edge.

8. The apparatus of claim 7 wherein said upper surface is at an angle of about 5°-30° from the horizontal.

9. A system for feeding a mixture of particles from a hopper onto a moving surface for electrostatic separation in a thin layer at the surface speed of said moving surface, the system comprising a frame and a feeder for feeding a mixture of particles onto a vibrating surface inclined downwardly from a back wall adjacent said hopper to an elongated discharge edge positioned vertically above and closely adjacent to said moving surface; a single rotating means connected to said vibrating surface for imparting reciprocatory movement to said vibrating surface generally perpendicular to said discharge edge and substantially parallel to said vibrating surface; means for support said vibrating surface at four points of attachment to said frame, two of which being laterally spaced and adjacent respective ends of said elongated discharge edge and the other tow of which being at said back wall closely adjacent to and spaced apart substantially equally form a centerline of said vibrating surface perpendicular to said discharge edge; and an elongated skirt of independently movable flexible fringes connected to said frame and suspended above and spaced closely to said discharge edge for providing a dust barrier upstream from said discharge edge.

10. The system of claim 9 wherein said means for supporting said vibrating surface are vibration absorbing attachments connecting said vibrating surface to said frame of said system.

11. The system of claim 9 wherein said rotating means is a motor having eccentric weights, a plate mounting said motor rigidly to said vibrating surface, said plate having a plurality of vertically spaced positions for mounting said motor in selected spaced positions.

12. The system of claim 9 wherein said means for supporting said vibrating surface include vibration absorbing attachments, said two points of attachment adjacent said discharge edge including a plurality of horizontally spaced locations for selective attachment of said vibration absorbing attachments at selected spaced locations.

13. The system of claim 9 wherein said vibrating surface is set at an angle with the horizontal of about 5°-30°.

14. In an electrostatic particle separating apparatus comprising a supply hopper for holding the particles, a frame and a generally horizontal pan for receiving particles from said hopper, and an electrostatically charged elongated rotating roll onto which particles are fed from said pan, said pan having a generally inclined receiving surface with a back wall, two side walls, and an elongated front edge extending parallel to and substantially coextensive with said roll, said surface being adapted to receive said particles adjacent said back wall and being inclined downwardly from said back wall to said front edge with said front edge being spaced vertically above said roll, a single linear vibration means attached to said pan adjacent said back wall adapted to cause said pan to vibrate in a generally horizontal direction substantially perpendicular to said front edge and to cause said particles thereon to declump as they are accelerated toward said front edge, said pan being supported by and attached to said frame through a pair of spaced front vibration absorbers and a pair of spaced rear vibration absorbers, said vibration absorbers being capable of absorbing substantially all vibrations of said pan and transmitting substantially no vibrations to said frame, said linear vibration means causing said particles to attain a speed generally commensurate with the speed of said roll and to cause the particles as they exit from said edge onto said roll to be a single layer thick to enhance the electrostatic separation effected by said drum.

15. The apparatus of claim 14 wherein said rear vibration absorbers are located generally medially of said side walls and attached to said back wall spacedly above said receiving surface.

16. The apparatus of claim 15 wherein said pan includes a vibration means support plate rigidly attached to said back wall of said pan medially of said two side walls, and said plate having a plurality of spaced attachment holes to accommodate attachment of said vibration means at a plurality of different locations to cause small alteration of the direction of the vibrational forces.

17. The apparatus of claim 14 wherein said front vibration absorbers are selectively positionable at differing distances rearwardly from said front edge.

18. The apparatus of claim 17 further comprising two parallel horizontal beams rigidly attached respectively to said two side walls of said pan, each said beam extending from adjacent said back wall to adjacent said front edge and having a flange extending outwardly from said respective side wall, each said flange having a plurality of spaced holes therethrough to accommodate attachment of one of said front vibration absorbers thereto.

19. The apparatus of claim 14 wherein said inclined surface is positioned at an angle that particles traveling down said surface being vibrated by said vibration means are accelerated in speed and declumped as said particles approach said front edge, said angle being between 5°-30° from the horizontal.

20. The system of claim 14 wherein said vibration means is an electric motor having eccentric weights, a generally vertical plate rigidly attached to said back wall of said pan, said plate having a plurality of vertically spaced attachment positions for mounting said vibration means selectively in one of said positions.

21. A particle accelerator comprising a frame and an elongated pan having an elongated back wall, two side walls, an elongated front edge and a bottom surface for receiving and supporting particles, said bottom surface being inclined downwardly from a high elevation at said back wall to a low elevation at said front edge; a single rotating eccentric motor, selective attachment means for connecting said motor to said back wall at any of a plurality of vertical attachment locations and, when said motor is operating, being adapted to cause said bottom surface to vibrate generally in a direction perpendicular to said front edge and said back wall, said pan having a plurality of vibration dampening attachment means for connecting said pan to said frame, and means for delivering particles to said pan.

22. The accelerator of claim 21 wherein said bottom surface is adjustable to positions wherein the slope of said surface from the horizontal is 5°-30°.

23. The accelerator of claim 21 wherein said vibration dampening attachment means includes four rubber mounted bolt means, two of which being adjacent the two respective ends of said front edge and two of which are located medially of said two side walls and at said back wall.

* * * * *